US007717036B2

(12) United States Patent
Li

(10) Patent No.: US 7,717,036 B2
(45) Date of Patent: May 18, 2010

(54) MULTIFUNCTIONAL TAPE PRINTER OF TAPE MEASURE

(76) Inventor: Guojian Li, Ningbo Morning Star Pet Goods Co.., Ltd., No. 18 Hongyun Road, Liang-Hui Economic Development Zone, Yuyao City, Zhejiang (CN) 315403

( * ) Notice: Subject to any disclaimer, the term of this patent is extended or adjusted under 35 U.S.C. 154(b) by 310 days.

(21) Appl. No.: 11/969,395

(22) Filed: Jan. 4, 2008

(65) Prior Publication Data

US 2008/0168916 A1 Jul. 17, 2008

(30) Foreign Application Priority Data

Jan. 15, 2007 (CN) ..... 2007 1 0066701

(51) Int. Cl.
*B41F 17/10* (2006.01)

(52) U.S. Cl. ..... 101/37; 101/35; 101/219

(58) Field of Classification Search ..... 101/35, 101/36, 37, 219, 220
See application file for complete search history.

(56) References Cited

U.S. PATENT DOCUMENTS 3,084,622 A * 4/1963 Roe ..... 101/228
3,162,117 A * 12/1964 Young ..... 101/219
4,051,774 A * 10/1977 Barnes et al. ..... 101/37
4,135,447 A * 1/1979 Barnes et al. ..... 101/177

* cited by examiner

*Primary Examiner*—Leslie J Evanisko
(74) *Attorney, Agent, or Firm*—Global IP Services; Tianhua Gu

(57) ABSTRACT

A multifunctional tape printer of tape measure, is provided with a main frame (1), a small number (for foot) roller (3) with the perimeter of 3 feet or/and a small number (for meter) roller (5) with the perimeter of 1 meter mounted on the main frame (1), pinch rollers and rubber brush on the rollers as well as ink supply device and tape conveying devices, which constitute the main body of the tape printer, the tape printer being featured by that an additional functional component of a large number (foot) roller (4) or/and large number (meter) roller (6) are mounted on the main frame (1) for matching with the small number (for foot) roller (3) with the perimeter of 3 feet or/and the small number (for meter) roller (5) with the perimeter of 1 meter, the large number roller(s) is/are kept at the same linear velocity to that of the small number roller(s), moreover, the large number roller and small number roller, through the proportioning of mechanical transmission rotating speed, achieve that when a small number roller rotates for one circle, the corresponding large number roller will rotate for an angle of a large number unit. It can print both large numbers and small numbers mechanically at the same time, which has high efficiency, fine printing precision and low rate of rejects and can reduce labor intensity.

10 Claims, 8 Drawing Sheets

MULTIFUNCTIONAL TAPE PRINTER OF TAPE MEASURE

CROSS REFERENCE TO RELATED PATENT APPLICATION

This patent application claims the priority of the Chinese patent application No. 200710066701.5 with filing date of Jan. 15, 2007.

FIELD OF THE INVENTION

This invention relates to a printer, and more particularly to a printer used for printing on tape measures made of plastic, steel or other flexible materials.

BACKGROUND OF THE INVENTION

Presently, many countries in the world adopts both the metric and the British systems for the measurement of length, therefore, the plastic tape measures people are using mainly combines meters of the metric unit and feet of the British system, i.e., meters are printed on one side and feet are printed on the other side.

There are several main problems to be solved for tape measures made of plastic, plastic reinforced with fiberglass or sackcloth etc.

There's another difficult problem to be solved: the large measurements on the tape numbers cannot be printed mechanically. Said large numbers means numbers printed on the tape indicating whole numbers like 1 m, 2 m . . . 30 m . . . and 1 ft, 2 ft . . . 100 ft . . . . In comparison with large numbers, we call repeatedly appearing graduation and text indicating centimeters or inches within every meter or inch the small numbers.

Traditional tape printers of tape measure can only print small numbers and cannot print large numbers. Limited by the diameter of the form roller, in general, rollers for small numbers in a meter can only adopt 1 m as the perimeter, while rollers for small numbers in a foot often adopt the perimeter of 3 feet, i.e., 0.9144 m so as to be close to that of the rollers for small numbers in meters. Both sides are printed at the same time, the numbers in the meter side will repeat every meter, and that in the foot side will repeat every 3 feet (actually 3 independent but end-to-end feet). Then, how can large numbers in the unit of meter or foot are printed? For example, for a 30-meter-long tape measure, 1 m, 2 m, 3 m . . . 29 m, 30 m shall be printed on the meter side and 1 ft, 2 ft, 3 ft . . . 99 ft, 100 ft shall also be printed on the foot side. The traditional method is: after printing all small numbers of both sides by machine, and then print the large numbers by screen printing or other means one by one.

This is a very troublesome process, which not only needs to be done manually, but also has the disadvantages of slow printing speed, great labor intensity, covering large space, high rate of defective products and unstable quality. The method to print the large numbers by silk-screen printing or other means one by one has been followed all over the world since the first tape measure appeared.

SUMMARY OF THE INVENTION

The initial problem for this invention to solve is to provide a multifunctional tape printer of tape measure that can print both large numbers and small numbers mechanically at the same time, which has high efficiency, fine printing precision and low rate of reject products and can reduce labor intensity.

One problem for this invention to solve is to provide a kind of a multifunctional tape printer of tape measure that can print large numbers and small numbers of both the metric system and the British system on both sides mechanically at the same time once and for all, which has high efficiency, fine printing precision and low rate of reject products and can reduce labor intensity.

The technical solution of this invention to solve the technical problem mentioned above is as shown in the attached figure: a multifunctional tape printer of tape measure, comprising the main frame, a small number (for foot) roller with the perimeter of 3 feet or/and a small number (for meter) roller with the perimeter of 1 meter mounted on said main frame, pinch rollers and rubber brush on said rollers as well as ink supply device, tension-adjusting device and tape conveying devices, which constitute the main body of the tape measure printer, said tape measure printer being featured by that an additional functional component of a large number (foot) roller or/and large number (meter) roller is/are mounted on said main frame for matching with said small number (for foot) roller with the perimeter of 3 feet or/and said small number (for meter) roller with the perimeter of 1 meter, said large number roller(s) is/are kept at the same linear velocity to that of said small number roller(s), moreover, said large number roller(s) and small number roller(s), through the proportioning of mechanical transmission rotating speed, achieve that when a small number roller rotates for one circle, the corresponding large number roller will rotate for an angle of a large number unit.

The function of said additional functional component of a large number (meter) roller is that: large numbers (meter) are engraved on the cylinder, like 1 m, 2 m, 3 m . . . etc., rubber brush is intermittently engaged with the numbers on the cylinder for printing the numbers on the large number (meter) cylinder on tape one by one.

A crucial point of this invention is that it adopts intermittent printing of the rubber brush and print numbers with large spacing with a cylinder with small diameters.

For example, for a 30-meter tape measure, the perimeter of the large number (meter) roller cannot be 30 meters, which is unpractical. Now we engrave numbers like 1 m, 2 m, 3 m . . . 29 m and 30 m etc., on a cylinder with very small diameter, which should be suitable when there's no mixture of ink between two neighboring numbers. In this way, the diameter of a large number roller of the metric system can be greatly reduced to a very small size provided it is allowed for practical operation.

How to realize the location change of large numbers one by one is another crucial point of this invention.

When designing the rotating speed of cylinders of rollers, we set the corresponding pinch rollers (i.e., rubber brushes) on the small number (meter) roller and the large number (meter) roller at the same linear velocity and the same period (i.e., adopting the same diameter), while that on the small number (meter) roller and the large number (meter) roller at the same linear velocity but different period (i.e., adopting different diameters), that is, the rubber brush does not always touch the large number (meter) roller's cylinder at the same time, instead, the contact point will continuously shift for a group of numbers every time, which realizes printing the numbers on the large number roller on the tape one by one. For example, for a 30-meter tape measure, it has altogether 31 (or other) groups of numbers, when the small number (meter) roller's cylinder turns 360°, the large number (meter) cylinder should turn (360°/31)×30 to achieve the displacement. Of course, there are multiple methods of calculation provided they meet the requirements for the displacement.

Similarly, the function of the additional functional component of a large number (foot) roller is: large numbers (foot) like 1 ft, 2 ft and 3 ft . . . etc. are engraved on the cylinder, the rubber brush is engaged intermittently with numbers on the cylinder for printing the large numbers on the large number (foot) roller on the tape one by one.

A very beneficial improvement is that the numbers on said large number (foot) roller are arranged in 3 lines, said tape is wound on said foot rubber brush on said large number (foot) roller via the pulley mechanism for 2 circles to match the three groups of parallel tapes with the 3 lines of large numbers on said large number (foot) roller.

Here, the printing of large numbers (foot) is different from the printing of large numbers (meter) in that: 1 m is approximately equal to 3.281 foot. For a 30-meter tape measure, there are only about 31 large numbers (meter), while the large numbers (foot) are about 100. The small number (foot) roller and the large number (foot) roller run at the same linear velocity, as the perimeter of the small number (foot) roller is 3 foot, it will print the length of 3 feet when it runs for a circle. Then, the large number (foot) roller has to print three large numbers in a circle. This invention adopts the method to: wind the tape around the rubber brush for 2 circles on top of the large number (foot) roller, allowing 3 tapes run parallel on top of the large number (foot) roller, in this way, the (foot) rubber brush can print 3 parallel tapes (actually different sections of a tape) at the same time, which achieved the goal to printing 3 large numbers when the rubber brush run for a circle.

Due to the reason above, 3 lines of numbers need to be engraved on the large number (foot) roller, while only one line of numbers need to be engraved on the large number (meter) roller.

Another very beneficial improvement is that said pulley mechanism at least comprises a pair of pulley wheels distributed on the front and rear positions of said large number (foot) roller's cylinder, said pulley wheels being 3-slot pulleys engaged with the 2-slot pulleys on the tension-adjusting device to constitute the pulley mechanism, which is simple and practical Another very beneficial improvement is that said small number (foot) roller is paired up with said large number (foot) roller and said small number (meter) roller is paired up with said large number (meter) roller, different pairs of rollers are allocated at the front and rear printing positions of said main frame. Said the main frame is provided with a tape-drying device between the front and rear printing mechanisms.

As said tape is flexible, it can turn 180° between the front and rear pulleys on the rear part of the drying device to print the other side. In this way, large and small numbers of the metric and the British systems can be printed on both sides of the tape at the same time.

Finally, said pinch roller on said small number cylinder is a rubber wheels kept at the same linear velocity to that of the small number roller, being a driven wheel, it turns in close contact with the small number roller. However, the rubber brush on top of the large number roller is a special rubber wheel kept in the same linear velocity to that of the large number roller, it makes the robber brush on the large number roller rotates for one circle, and the corresponding large number roller rotate for an angle of a large number unit.

Compared with existing technologies, this invention has the following advantages: It can print the large numbers and small numbers on the tape at the same time mechanically and, in the best embodiment, print the large numbers and small numbers of both the metric system and the British system on both sides of the tape at the same time, the printer according to this invention realized the transition from manual work to mechanical production, which has the advantages of greatly improving the quality of printing, easy operation and reducing production cost, and is reasonably and practically designed, multifunctional and promising.

DETAILED DESCRIPTION OF THE INVENTION

Detail description of the present invention will now be described with reference to the drawings.

As shown in FIG. 1-7, a tape measure printer comprising: 1. main frame; 2. tape; 3. small number (foot) roller; 4. large number (foot) roller; 5. small number (meter) roller; 6. large number (meter) roller; 7. pinch roller; 8. rubber brush; 9. pinch roller; 10. rubber brush; 11. tape feeding device; 12. tape withdrawing device; 13. ink supplying device; 14. pulley wheel; 15, 16, 17. location and tension-adjusting devices; 18. ink drying device; 31. small number (foot); 41. large number (foot); 51. small number (meter); 61. large number (meter).

Figure 6:
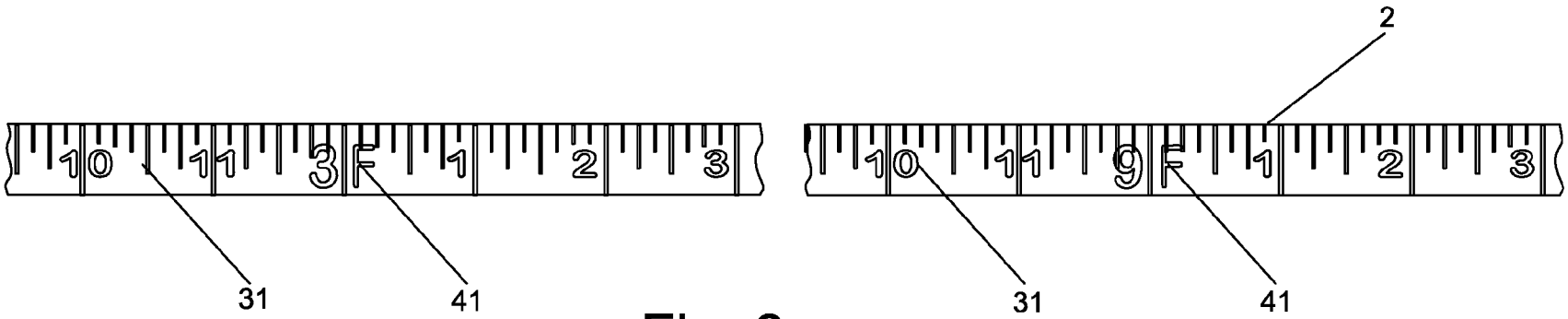
FIG. 6 is a plane view of the inch-side of the tape.
Figure 7:
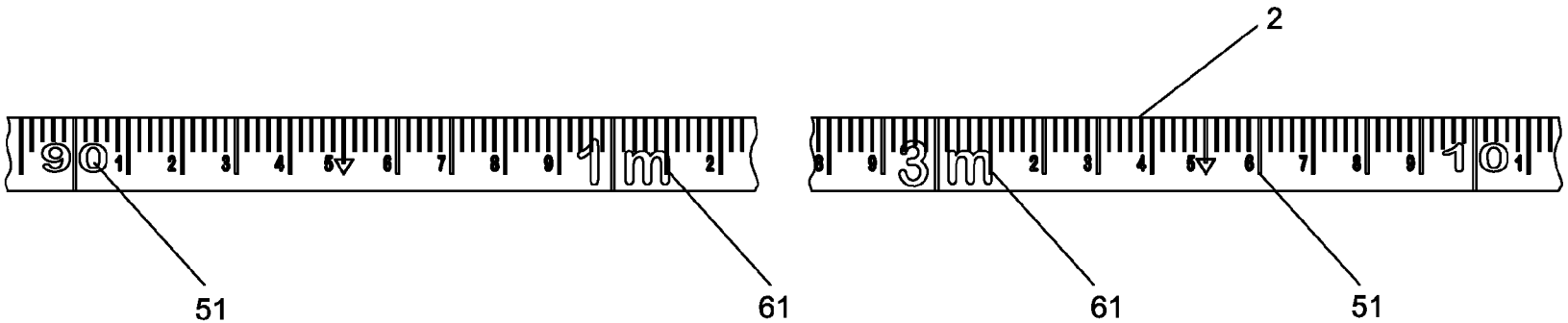
FIG. 7 is a plane view of the meter-side of the tape.

If the large number (foot) roller 4, large number (meter) roller 6 as well as corresponding affiliated devices are removed, this machine would be an ordinary tape printer of tape measure and the printed side of the tape would be like what's shown in FIG. 7, which has only small numbers 51 (meter) repeated within the period of a meter while no large numbers (meter) 61 like 1 m, 2 m and 3 m etc.; and the other side of the tape would be like what's shown in FIG. 6, which has only small numbers (foot) 31 repeated within the period of a foot while no large numbers (foot) 41 like 1 ft, 2 ft and 3 ft etc. The traditional method to solve the problem of large numbers is to print them by silk screen one by one, which not only costs man-hours, but also waste workplaces and moreover, the quality is not easily controlled, however, all manufacturers adopt this method instead of any better method.

This invention adopts the method and devices to engrave large numbers on the form cylinders to turn manual printing into automatic printing.

A multifunctional tape printer of tape measure, comprising a main frame 1, a small number (for foot) roller 3 with the perimeter of 3 feet and a small number (for meter) roller 5 with the perimeter of 1 meter mounted on said main frame 1, pinch rollers and rubber brush on said rollers as well as ink supply device 13, tension-adjusting devices 15, 16, 17 and tape conveying devices, which constitute the main body of the tape measure printer and is similar with that of a traditional printer. A crucial point of this invention is that additional functional components of a large number (foot) roller 4 and a large number (meter) roller 6 are matching with a small number (for foot) roller 3 and a small number (for meter) roller 5, where, said small number (foot) roller 3 is paired up with said large number (foot) roller 4 at the front printing mechanism of said main frame 1, said small number (meter) roller 5 is paired up with said large number (meter) roller 6 at the rear printing mechanism of said main frame 1, Said main frame is provided with a tape-drying device 18 between the front and rear printing mechanisms.

In the printer, the tape 2 moves forward at an even speed during the printing, and for every form cylinder, the speed at which the roller's cylinder contacts the tape 2 must be the same, i.e., the same linear velocity must be maintained, which, through the proportioning of mechanical transmission rotating speed, obtains the same linear velocity to that of the small number (foot) roller 3, the large number (foot) roller 4, the small number (meter) roller 5, the large number (meter) roller 6, the (foot) rubber brush 8 and the (meter) rubber brush 10.

In the embodiment of this invention, we set the perimeter of said small number (meter) roller 5 to 1 meter and that of said small number (foot) roller 3 at 3 feet (i.e., 0.9144 m), to provide cylinders with different perimeters with the same linear velocity, we just need to change the rotating speed. The speed ration of the small number (meter) roller 5 and the small number (foot) roller 3 shall be inversely proportional to their perimeters, i.e., 1/0.9144=1.0936. The speed ration of any other roller's cylinder including the rubber brush should be calculated by parity of reasoning. In a word, the linear velocity of rollers' cylinders must be kept the same.

Second, the rotation direction of rollers should be set: according to the requirements of serial printing, small number (foot) roller 3, large number (foot) roller 4, small number (meter) roller 5, large number (meter) roller 6 should all rotate in the same direction to that of the tape 2. However, rubber brush 8 and rubber brush 10 are different, in this embodiment, they should be driving wheels functioning as the printing pinch rollers and, according to the characteristics of printing pinch rollers, their rotation direction should be reverse to that of the rollers. Pinch roller 7 and pinch roller 9 are driven wheels, which rotate reversely in close contact with the small number rollers.

The large number (foot) roller 4 and the large number (meter) roller 6 do not adopt intermittent printing instead of continuous printing. That is, the large number roller and the small number roller through the proportioning of rotating speed of mechanical transmission, that when a small number roller rotates for one circle, the corresponding large number roller will rotate for an angle of a large number unit. Mechanical transmission may adopt gear transmission to achieve the proportion of rotating speed, which is the traditional way. The embodiment of this invention is: as shown in FIG. 2 and FIG. 3, to make the opposing pinch roller (foot) rubber brush 8 of large number (foot) roller 4 and (meter) rubber brush 10 of large number (meter) roller 6 into the shape of a brush, which is actually a special rubber pinch roller, i.e., most of the periphery is a vacant pinch roller, only when the rubber brush contacts the large number cylinder can angular motion of the rubber brush be activated, which just meet our requirement to choose the large number text we need for the printing.

When designing the rotating speed, we set the small number (meter) roller 5 and (meter) rubber brush 10 to run at the same linear velocity and the same period; while the small number (meter) roller 5 and the large number (meter) roller 6 to run as the same linear speed but different periods, i.e., when the small number (meter) roller 5 runs for a circle, the large number (meter) roller 6 does not run a circle or less or more than a circle but intends to be displaced at an angle of a large number. For a 30-meter tape measure, the large number (meter) has altogether 31 large numbers or so, when the large number (meter) roller 6 rotates, it will shift a location every time it touches the (meter) rubber brush 10, i.e., shifting for a large number, to make the large numbers (meter) on the large number (meter) roller 6 be printed on the tape 2 one by one, after printing 31 large numbers (meter), the large number (meter) roller 6 will finally complete a grand cycle.

Then it is necessary to arrange the numbers in numerical order when making the large number (foot) roller 4 and the large number (meter) roller 6.

Figure 2:
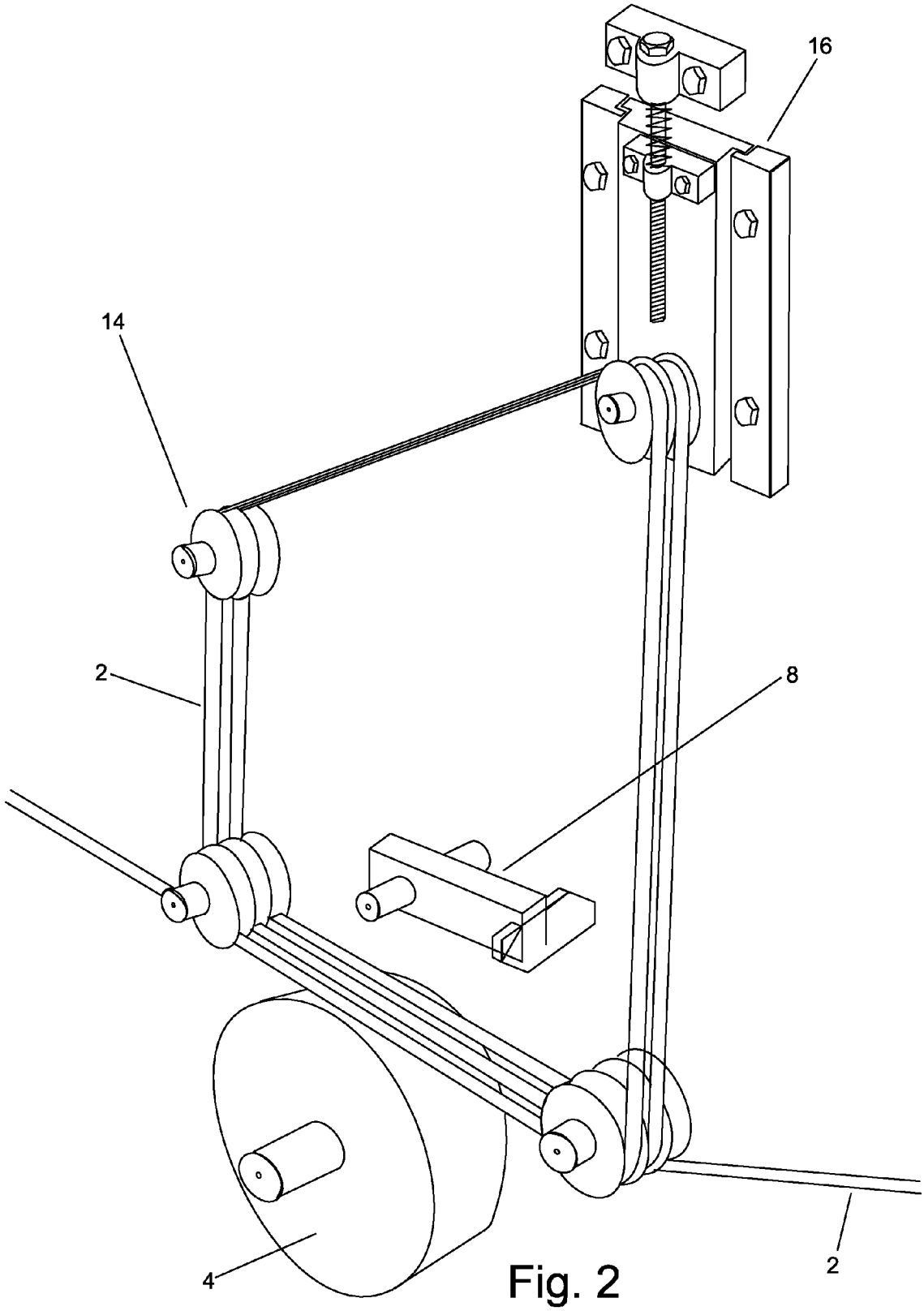
FIG. 2 is a 3D schematic diagram of the large number (foot) printing component.
Figure 3:
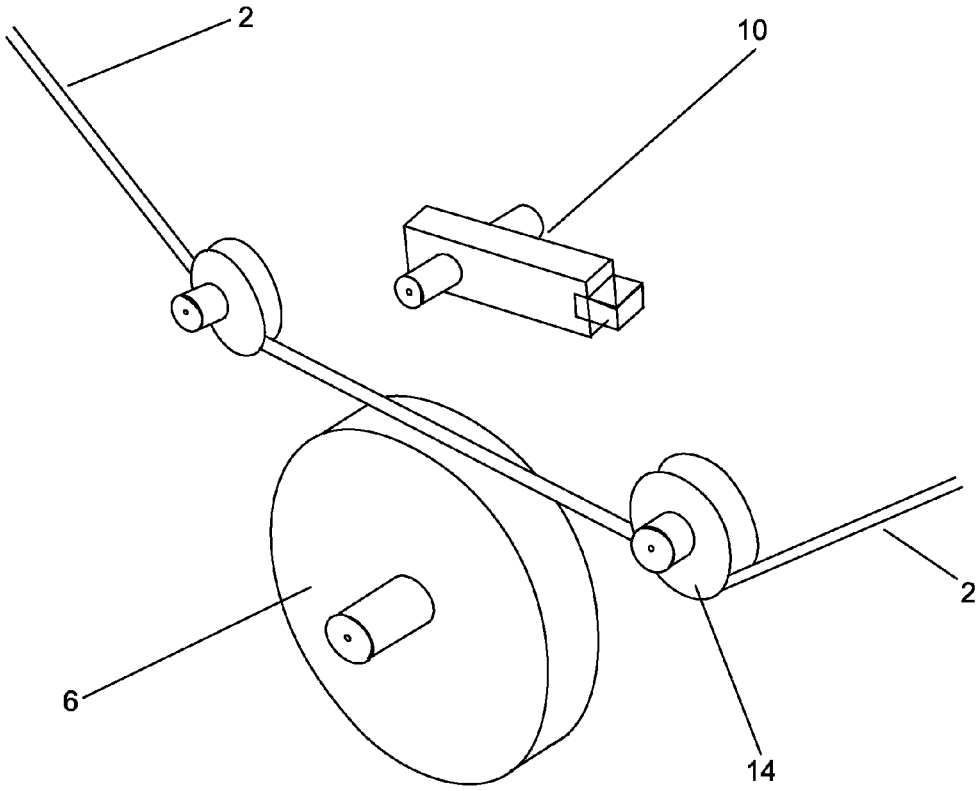
FIG. 3 is a 3D schematic diagram of the large number (meter) printing component.

Furthermore, as shown in FIG. 2, large number (foot) roller 4 is more special. Because when the small number (meter) roller 5 rotates a circle, small numbers of the metric system will be printed on the tape 2 and only one large number (meter) needs to be selected from the large number (meter) roller 6. At the same time, the small number (foot) roller 3 has also rotated for 1 circle (actually 1.0936 circles, because of the same linearly speed, it is required that when the small number (meter) roller 5 rotates for a circle, the small number (foot) roller must rotate for 1/0.9144=1.0936 circles), small number (foot) will be printed on the tape 2. However, during the same period of time, the large number (foot) roller 4 and the (foot) rubber brush 8 cannot rotate for 3 circles.

Therefore, another crucial solution of this invention is that: numbers on the large number (foot) roller 4 are arranged in 3 lines 41, tape 2 of the tape measure is wound on the (foot) rubber brush 8 on the large number (foot) roller 4 for 2 circles via the pulley mechanism to make the 3 mutually parallel tapes 2 engage with the 3 lines of large numbers on the large number (foot) roller 4. Neighboring numbers on each line are large numbers in the numerical order, while the difference between the large number and the small number in neighboring lines matches the length of the wound tape for each circle, which should be multiples of the unit of the large number, this can facilitate the practical design and operation of the large number (foot) roller 4, and of course, there are many similar arrangements.

The pulley mechanism at least comprises a pair of pulley wheels distributed on the front and rear positions of said large number (foot) roller 4, said pulley wheels being 3-slot pulleys engaged with the 2-slot pulleys on the tension-adjusting device 16 to constitute the pulley mechanism. In this embodiment, the pulley mechanism adopts 3 pulley wheels to ensure multiple returns of the conveying route of tape 2, as shown in FIG. 2, tape 2 is wound on the rubber brush 8 for 2 circles and its length must be multiples of an entire foot so as to avoid inaccurate engagement of large numbers (foot) with small numbers (foot).

Figure 1:
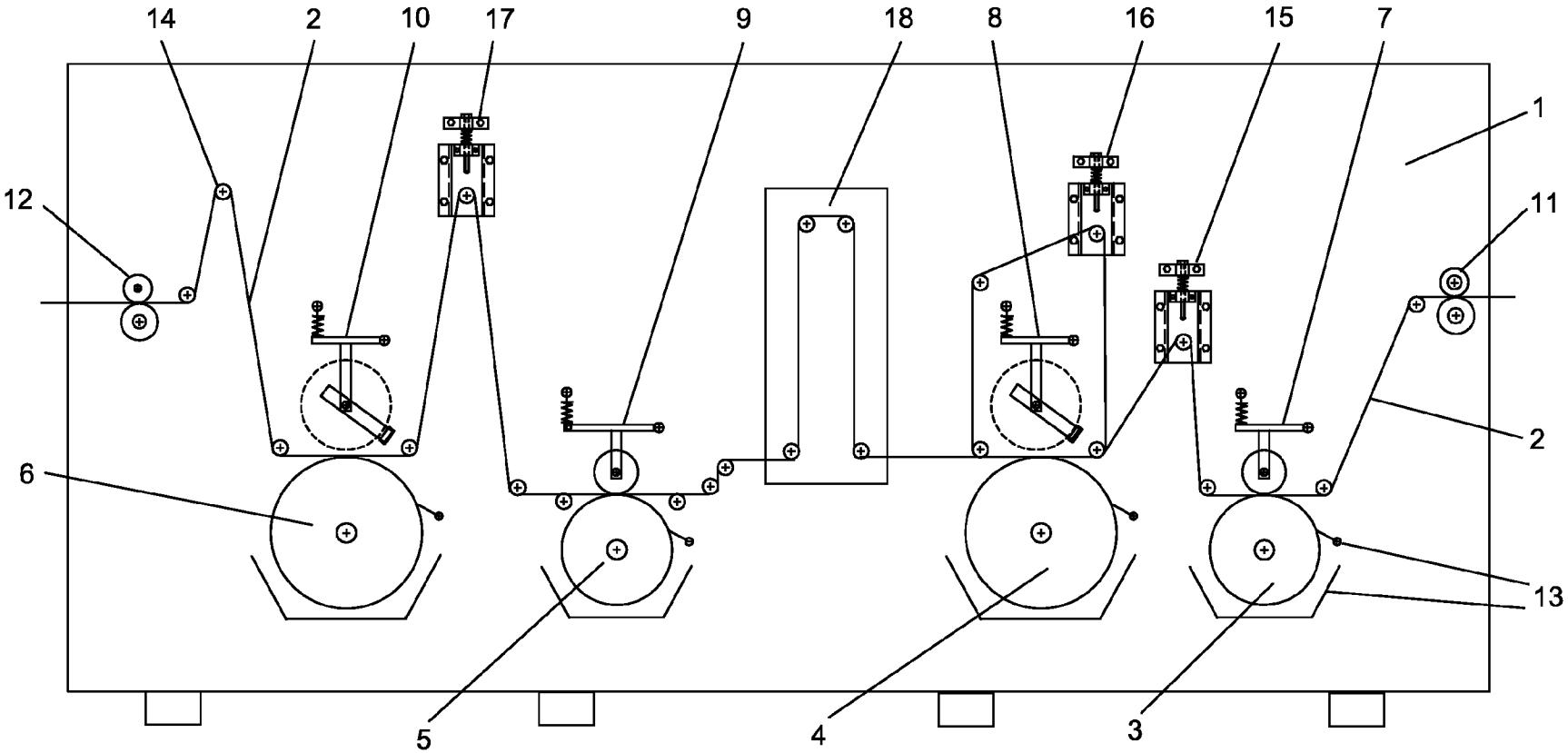
FIG. 1 is the first schematic diagram of the multifunctional tape printer of tape measure.
Figure 4:
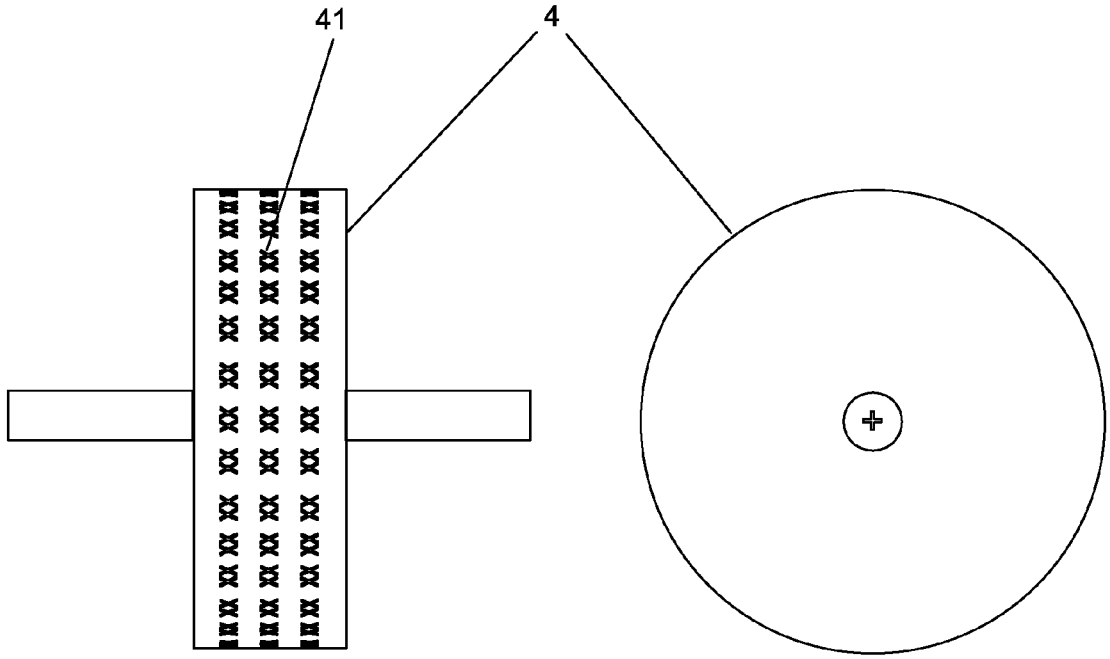
FIG. 4 is 2D view of the large number for feet.
Figure 5:
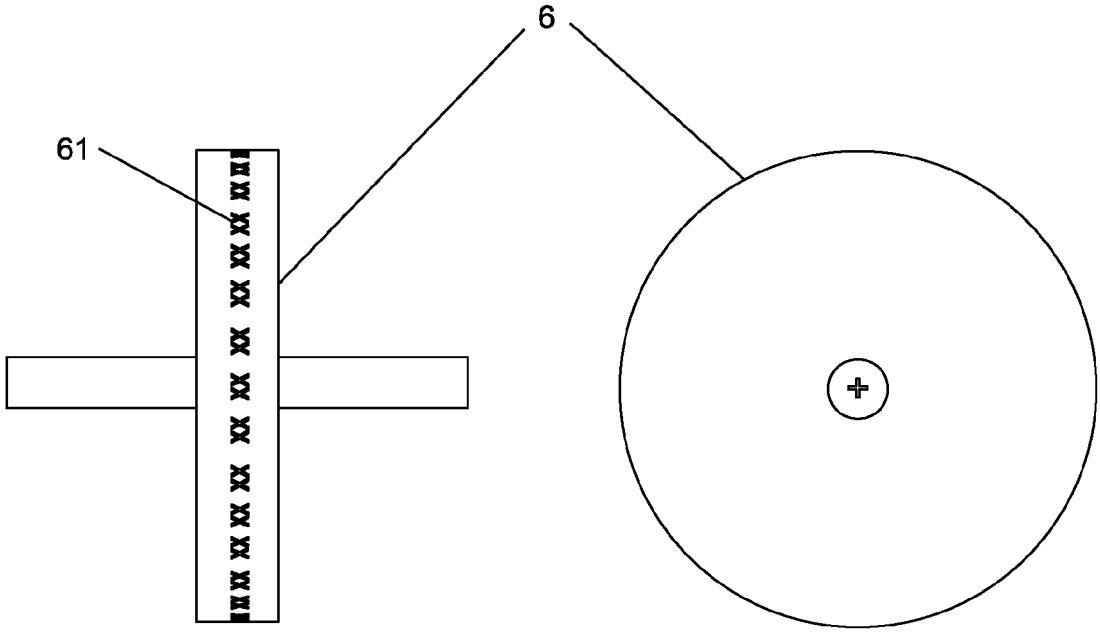
FIG. 5 is 2D view of large number for meters.

Therefore, as shown in FIG. 4, 3 lines of large numbers (foot) on engraved on the large number (foot) roller 4, when the (foot) rubber brush 8 runs for one circle, 3 large numbers (foot) will be printed at the same time, which effectively solves the problem of the ratio of a meter and a foot (approximately 1:3). And when the large number (meter) roller 6 and the (meter) rubber brush 10 print large numbers (meter), as shown in FIG. 1 and FIG. 3, there's no need for the tape 2 to be wound on top of them, just let the tape pass them directly.

Finally, the rubber brushes on top of the small number rollers are rubber wheels with the same linear velocity to that of small number rollers, i.e., pinch roller 7 and 9, while that on top of the large number rollers are special rubber wheels kept at the same linear velocity to that of the large number rollers, most of its periphery is vacant and through the proportioning of mechanical transmission rotating speed, it makes the rubber brush on the large number roller rotates for one circle, and the corresponding large number roller rotates for an angle of a large number unit. For example, for 30-meter tape measure, it has altogether 31 (or other) groups of numbers, when the small number (meter) roller turns 360°, the large number (meter) roller should turn (360°/31)×30 to achieve the displacement. Of course, there are multiple methods of calculation provided they meet the requirements for the displacement.

As tape 2 is flexible, it can turn 180° between the front and rear pulleys on the rear part of the drying device to print the other side. In this way, large and small numbers of the metric and the British systems can be printed on both sides of the tape at the same time.

This intention provides a novel tape measure printer with reasonable design and convenient operation that can reduce the labor intensity of workers, decrease the production cost and improve the quality of products on the basis of existing background technologies.

Figure 8:
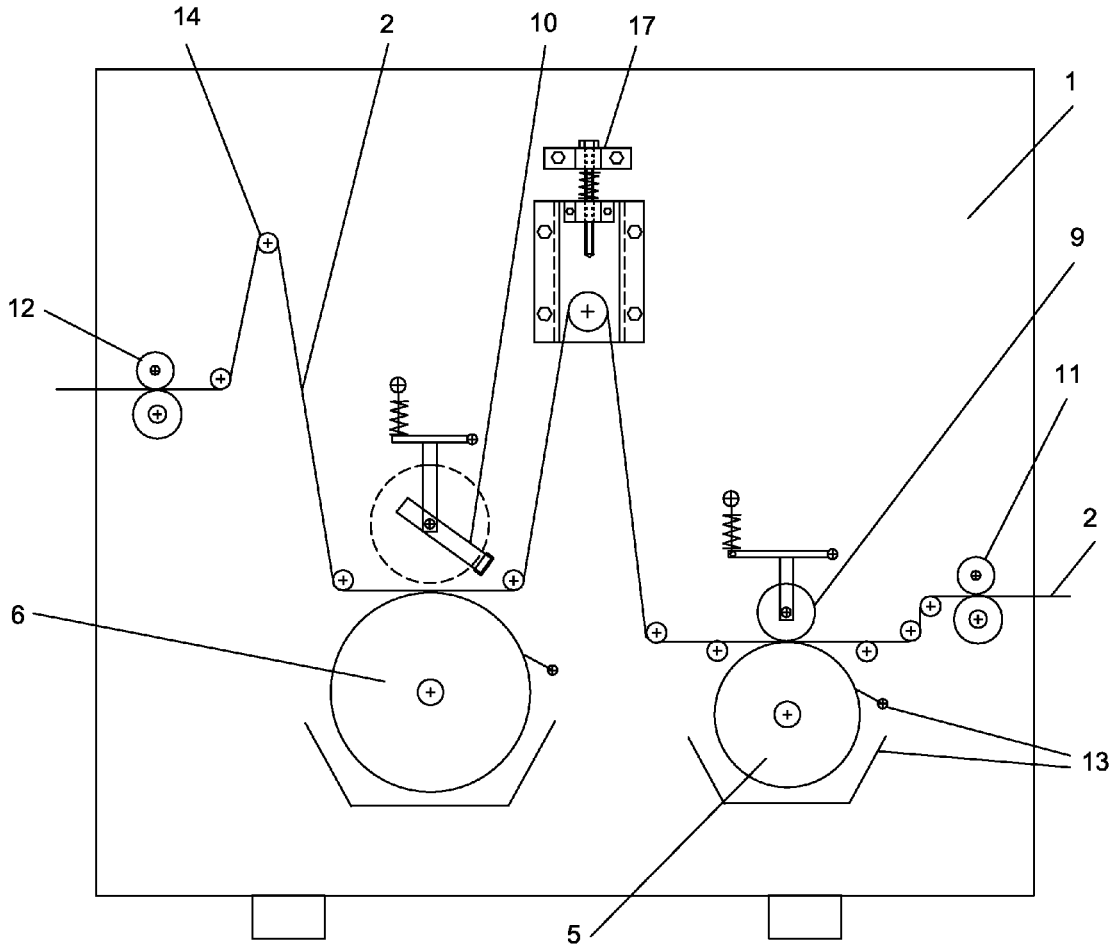
FIG. 8 is a second schematic diagram of the multifunctional tape printer of tape measure.

Another embodiment of the present invention is shown in FIG. 8. A tape printer of tape measure comprising a main frame 1, a small number (meter) roller 5 with the perimeter of 1 meter on said main frame 1, pinch roller and rubber brush on said roller as well as ink supply device, tension-adjusting device and tape conveying devices, which constitute the main body of the tape printer, said tape printer being featured by that an additional functional component of a large number (meter) roller 6 matching with said small number (meter) roller 5 with the perimeter of 1 meter on said main frame 1, said large number roller is kept at the same linear speed to that of said small number roller, moreover, said large number roller and small number cylinders, through the proportioning of mechanical transmission rotating speed, achieve that when a small number roller rotates for one circle, the corresponding large number roller will rotate for an angle of a large number unit. This realized printing the large numbers and small numbers of the metric system on tape 2 at the same time according to the same principle of what described above, and no further description will be given here.

Figure 9:
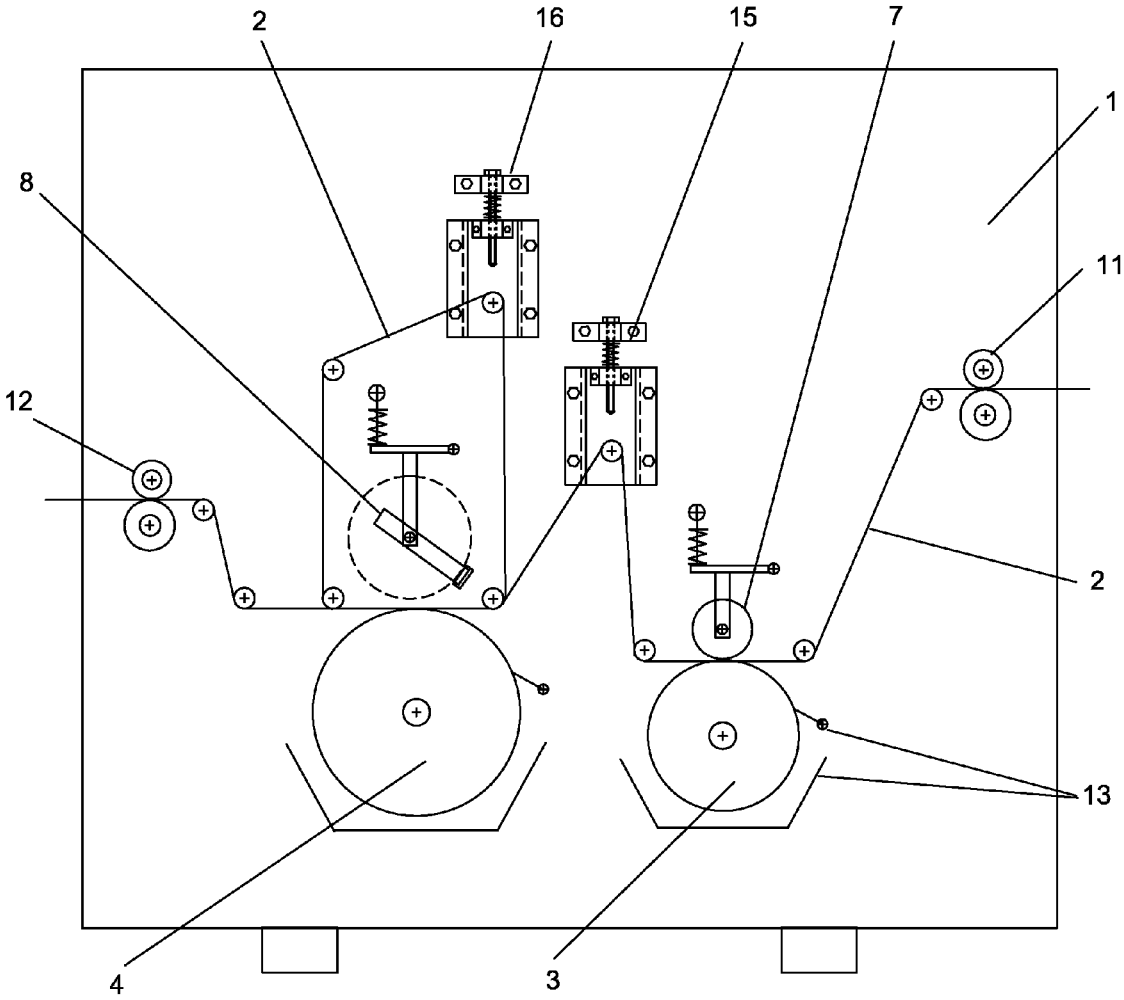
FIG. 9 is a third schematic diagram of the multifunctional tape printer of tape measure.

Another embodiment of the present invention is shown in FIG. 9. A tape printer of tape measure comprising a main frame 1, a small number (foot) roller with the perimeter of 3 feet on said main frame 1, pinch roller and rubber brush on said roller as well as ink supply device, tension-adjusting device and tape conveying devices, which constitute the main body of the tape printer, said tape printer being featured by that an additional functional component of a large number (foot) roller 4 matching with said small number (foot) roller 3 with the perimeter of 3 feet on said main frame 1, said large number roller is kept at the same linear velocity to that of said small number roller, moreover, said large number roller and small number roller, through the proportioning of mechanical transmission rotating speed, achieve that when a small number roller rotates for one circle, the corresponding large number roller will rotate for an angle of a large number unit. This realized printing the large numbers and small numbers of the British system on tape 2 at the same time according to the same principle of what described above, and no further description will be given here.

It should be emphasized that the term "multifunctional" in the title of multifunctional tape printer of tape measure indicates that the printer can print not only small number units but also both large number and small number units at a same time on the tape measure.

What is claimed is:

1. A multifunctional tape printer of a tape measure comprising: a main frame (1), a small number (foot) roller (3) with a perimeter of 3 feet, a small number (meter) roller (5) with a perimeter of 1 meter mounted on said main frame (1), pinch rollers and rubber brushes above said number rollers, ink supply devices, tension-adjusting devices and tape conveying devices; wherein a large number (foot) roller (4) and a large number (meter) roller (6) are mounted on said main frame (1) for matching with said small number (foot) roller (3) and said small number (meter) roller (5); said large number (foot and meter) rollers are kept at a same linear velocity to that of said small number (foot and meter) rollers; moreover, said large number (foot and meter) rollers and small number (foot and meter) rollers, through a transmission device, achieve that when the small number roller rotates for one circle, the corresponding large number roller rotates for an angle of a large number unit.

2. The multifunctional tape printer of tape measure according to claim 1, wherein text of large numbers on the periphery of said large number (foot) roller (4) are arranged in three lines (41), correspondingly, the tape of said tape measure (2) encircles said foot rubber brush (8) via a pulley mechanism becoming three parallel tapes (2) above the 3 lines text of large numbers on said large number (foot) roller (4).

3. The multifunctional tape printer of tape measure according to claim 2, wherein said pulley mechanism at least comprises a pair of pulley wheels distributed on the front and rear positions of said large number (foot) roller (4), said pulley wheels are 3-slot pulleys engaged with 2-slot pulleys on the tension-adjusting device to constitute the pulley mechanism.

4. The multifunctional tape printer of tape measure according to claim 1, wherein said small number (foot) roller (3) and said large number (foot) roller (4) pair up for printing foot tape and said small number (meter) roller (5) and said large number (meter) roller (6) pair up for printing meter tape, different pairs of rollers are allocated at the front and rear printing positions of said main frame.

5. The multifunctional tape printer of tape measure according to claim 4, wherein said main frame is provided with an ink-drying device (18) between the front and the rear pair of rollers.

6. The multifunctional tape printer of tape measure according to claim 1, wherein the rubber brushes (8, 10) above said large number rollers are special rubber wheels with most part of the periphery being vacant, the rubber brushes kept at the same linear velocity to that of said large number rollers, through a transmission device, when said rubber brush rotates for one circle, corresponding large number roller will rotate for an angle of a large number unit.

7. A multifunctional tape printer of a tape measure comprising: a main frame (1), a small number (foot) roller (3) with a perimeter of 3 feet mounted on said main frame (1), a large number (foot) roller (4) is mounted on said main frame (1) for matching with said small number (foot) roller (3), pinch rollers and rubber brushes on said number rollers, ink supply devices, tension-adjusting devices and tape conveying devices; wherein said large number roller is kept at a same linear velocity to that of said small number roller; moreover, said large number roller and small number roller, through a transmission device, achieve that when the small number roller rotates for one circle, the corresponding large number roller rotates for an angle of a large number unit.

8. The multifunctional tape printer of tape measure according to claim 7, wherein text of large numbers on the periphery of said large number (foot) roller (4) are arranged in three lines (41), correspondingly, the tape of said tape measure (2) encircles said foot rubber brush (8) via a pulley mechanism becoming three parallel tapes (2) above the 3 lines text of large numbers on said large number (foot) roller (4).

9. The multifunctional tape printer of tape measure according to claim 8, wherein said pulley mechanism at least comprises a pair of pulley wheels distributed on the front and rear positions of said large number (foot) roller (4), said pulley wheels are 3-slot pulleys engaged with 2-slot pulleys on the tension-adjusting device to constitute the pulley mechanism.

10. A multifunctional tape printer of a tape measure comprising: a main frame (1), a small number (meter) roller (5) with a perimeter of 1 meter mounted on said main frame (1), a large number (meter) roller (6) is mounted on said main frame (1) for matching with said small number (meter) roller (5), pinch rollers and rubber brushes on said number rollers as well as ink supply devices, tension-adjusting devices and tape conveying devices; wherein said large number roller is kept at a same linear velocity to that of said small number roller; moreover, said large number roller and small number roller, through a transmission device, achieve that when the small number roller rotates for one circle, the corresponding large number roller rotates for an angle of a large number unit.

* * * * *